US005168130A

United States Patent [19]

Shima et al.

[11] Patent Number: 5,168,130

[45] Date of Patent: Dec. 1, 1992

[54] NOISE REDUCING APPARATUS

[75] Inventors: Hiroshi Shima, Kodaira; Masanori Murase; Naotaka Tomita, both of Sayama; Kazuyoshi Iida, Yokohama, all of Japan

[73] Assignee: Bridgestone Corporation, Tokyo, Japan

[21] Appl. No.: 376,091

[22] Filed: Jul. 6, 1989

[30] Foreign Application Priority Data

Jul. 6, 1988 [JP] Japan ..... 63-168557

[51] Int. Cl.[5] ..... F01N 1/06

[52] U.S. Cl. ..... 181/206; 181/286; 181/288

[58] Field of Search ..... 181/204, 206, 268, 281, 181/286

[56] References Cited

U.S. PATENT DOCUMENTS

| | | | |
|---|---|---|---|
| 4,156,476 | 5/1979 | Matsumoto et al. | 181/210 |
| 4,753,318 | 6/1988 | Mizuno et al. | 181/204 |
| 4,840,251 | 6/1989 | Murase et al. | 181/266 |
| 4,858,720 | 8/1989 | Murase et al. | 181/176 |

FOREIGN PATENT DOCUMENTS

| | | |
|---|---|---|
| 57-43797 | 9/1982 | Japan . |
| 60-85043 | 5/1985 | Japan . |

*Primary Examiner*—L. T. Hix
*Assistant Examiner*—Eddie C. Lee
*Attorney, Agent, or Firm*—Sughrue, Mion, Zinn, Macpeak & Seas

[57] ABSTRACT

A noise reducing apparatus comprising a first passageway group consisting of a plurality of first passageways aligned in parallel with each other for forming a first flat wave A by sound waves having a first same phase passed through each first passageway from a sound source, and a second passageway group consisting of a plurality of second passageways aligned in parallel with each other for forming a second flat wave B by sound waves being a second same phase passed through each second passageway from the sound source, said first passageway group having positioned above said second passageway group, and the phase of said first flat wave being advanced by a phase difference of 240°±60° with respect to the phase of said second flat wave to thereby reduce noise emitted from the sound source by interference of the first and second flat waves A and B.

8 Claims, 9 Drawing Sheets

NOISE REDUCING APPARATUS

BACKGROUND OF THE INVENTION (1) Field of the Invention

The present invention relates to a noise reducing apparatus comprising an interference type hollow body for reducing incident sound from a sound source by interference.

(2) Related Art Statement

As a method for lowering the noise level of the sound emitted from a noise source, there has hitherto been widely carried out a method of surrounding the noise source with a shielding structure lined with a sound insulating material to reduce noise by an acoustic absorbing treatment and a sound insulating treatment.

There has also widely been used a method of preventing propagation of noises by providing a high sound shielding wall for lowering the noise level.

However, the prior method of shielding sound cannot be applied to such a portion as an engine room of a vehicle which requires a vent for radiating heat.

Moreover, if a sound shielding wall is provided in the engine of an aeroplane emitting a sound by an exhaust stream, an air flow becomes turbulent to cause an obstacle in suction and exhaust of air. Accordingly, such sound cannot be shielded.

SUMMARY OF THE INVENTION

The invention is made by taking the above prior art into consideration, and aims to provide a noise reducing apparatus comprising a hollow body consisting of a plurality of passageways provided at opening portions without closing the circumference of a noise source for exhibiting a sound reducing effect by interfering sound waves.

In general, sound waves emitted from two sound sources, which phases are different by one half wavelength generate an extremely sound reducing region by interference on a two-half line perpendicular to a line connecting two sound sources.

The invention reduces noise emitted from one sound source by providing a plurality of passageways which passageway length is adjusted to generate a sound reducing region by interference in the same manner as the above two sound sources.

That is, the invention attains the above object by a noise reducing apparatus comprising a first passageway group consisting of a plurality of first passageways alligned in parallel with each other for forming a first flat wave by sound waves having a first same phase passed through each first passageway from a sound source, and a second passageway group consisting of a plurality of second passageways aligned in parallel with each other for forming a second flat wave by sound waves having a second same phase passed through each second passageway from the sound source, in said first passageway group being positioned above said second passageway group, and the first phase of said first flat wave being advanced by a phase difference of 240° ±60° with respect to the second phase of said second flat wave.

In the above construction, the reason why an allowable range of 60° is provided with respect to a reference phase difference of 240° and any phase difference within the allowable range is regarded as the same phase is because a sound reducing effect is hardly obtained, if a phase difference exceeds the range as shown in a graph of FIG. 8.

Particularly, if there is reflection by the surface of the earth and the like, it is appropriate to control a sound reducing region downward, and it is necessary to advance the phase of the upper passageway group by a phase difference of 240° ±60° with respect to the phase of the lower passageway group.

That is, as shown in a graph of FIG. 9, if an advance of the phase deviates from the range of 240° ±60°, a sound reducing effect by interference cannot be sufficiently obtained by an influence of reflection by the surface of the earth.

DETAILED DESCRIPTION OF THE PREFERRED EMBODIMENTS

Figure 1:
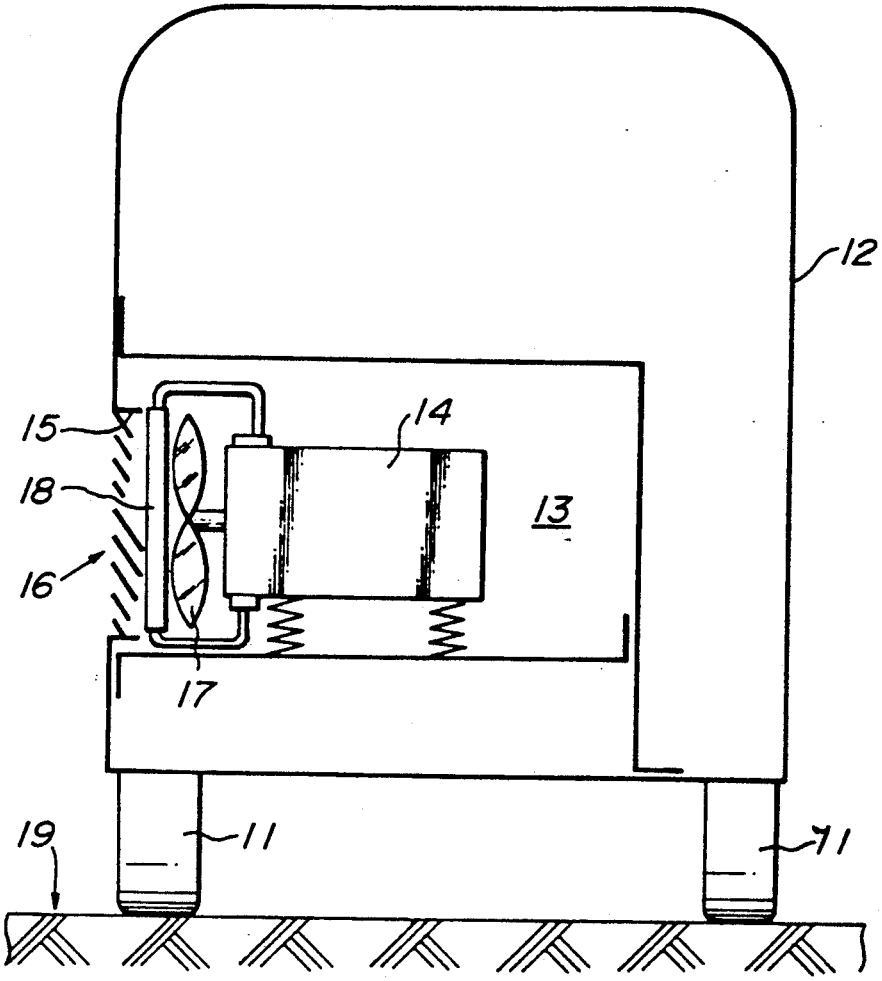
FIG. 1 is a cross sectional view of an engine room of a vehicle provided with a noise reducing apparatus according to one embodiment of the invention.

The invention will be explained by referring to FIGS. 1–7;

FIG. 1 illustrates a schematic cross section of an embodiment of the noise reducing apparatus according to the invention by applying to the engine room of an automobile.

Referring to FIG. 1, an engine room 13 is formed on a part of a body 12 provided on a chasis suspending running wheels 11 comprising both front wheels (steering wheels) and both rear wheels (driving wheels), and an engine 14 is mounted in the engine room 13.

On the outer wall surface of the engine room 14 is formed a vent 15, which is provided with a sound wave interference type noise reducing apparatus 16 according to the invention.

The engine 14 is of a lateral type, and a fan 17 and a radiator 18 are disposed on the side of vent 15 of the engine 14.

The engine 14 is generally supported on the floor of the engine room 13 by some damper.

In FIG. 1, reference numeral 19 shows the surface of the earth.

Figure 2:
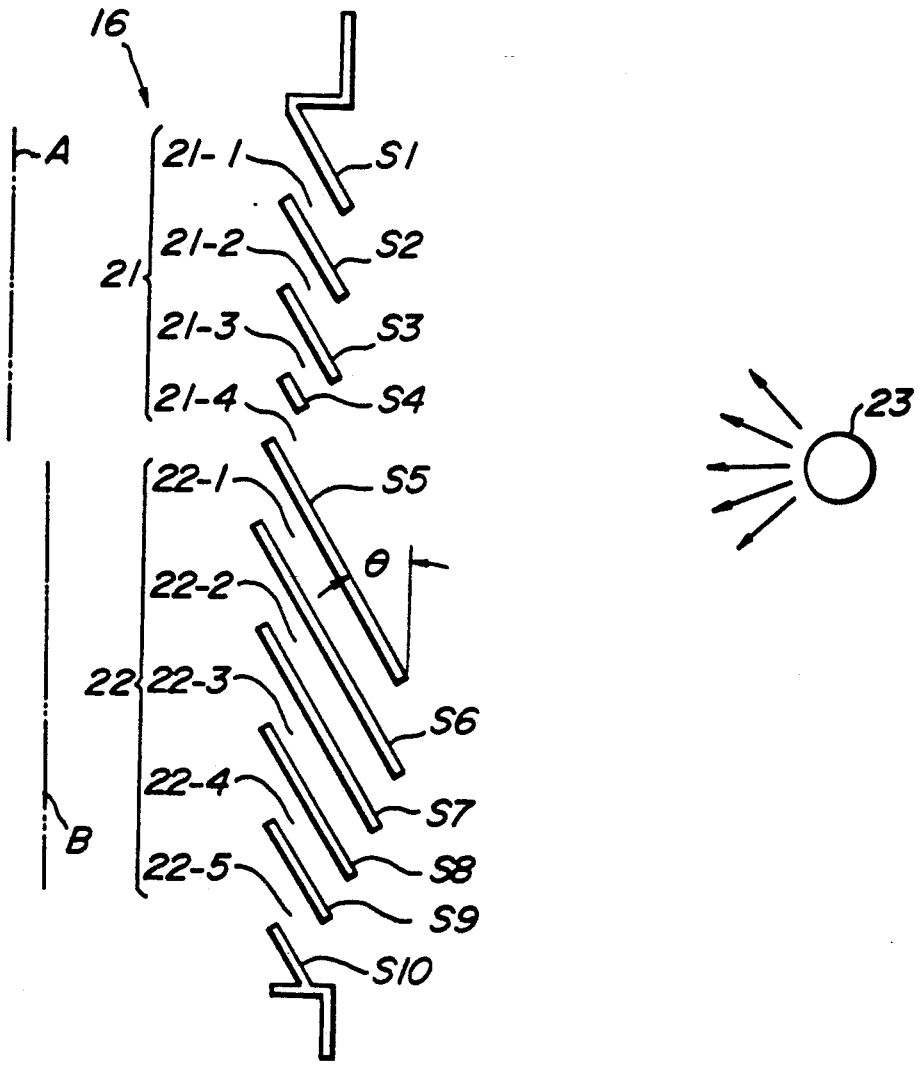
FIG. 2 is a longitudinal cross sectional view of the noise reducing apparatus shown in FIG. 1.

FIG. 2 illustrates a longitudinal cross section of the noise reducing apparatus 16 in FIG. 1.

This noise reducing apparatus 16 is formed in the form of a hollow body composed of a first upper passageway group 21 and a second lower passageway group 22.

The first passageway group 21 consists of a plurality of first passageways 21-1, 21-2, . . . **21-*n* aligned in parallel with each other, and is constructed to form a first flat wave A by sound waves having a first same phase passed through each first passageway 21-1, 21-2, . . . 21-*n* from a sound source 23 (the same as the engine 14 in FIG. 1**).

The second passageway group 22 consists of a plurality of second passageways 22-1, 22-2, ... **22-*m* aligned in parallel with each other, and is constructed to form a second flat wave B by sound waves having a second same phase passed through each second passageway 22-1, 22-2, . . . 22-*m* from the sound source 23**.

Each passageway 21-1, 21-2, . . . **21-*n*, 22-*l*, 22-2, . . . 22-*m* is formed with a predetermined inclined angle $\theta$ as illustrated, and these passageways can be arranged with various shapes such that each passageway is formed in the form of a slit having a certain width to form a blind as a whole hollow body 16, or concentric circle or concentric oval shape in accordance with the shape and size of the sound source 23**.

This noise reducing apparatus 16 is to reduce noises from the sound source 23 (engine 14) by interference.

For the above purpose, the length of each passageway **21-*i* ($i=1, 2, \ldots n$) of the first passageway group 21 is determined such that the sum of a distance from the sound source 23 to the passageway inlet, a length of the passageway and a distance from the passageway outlet to an outward imaginary plane is maintained to a constant length LA to form a plane wave A by composing wave surfaces of re-emitted sound waves having the first same phase after passing through each passageway 21-*i***.

The length of each passageway **22-*i* ($i=1, 2, \ldots m$) of the second passageway group 22 is also determined such that the sum of a distance from the sound source 23 to the passageway inlet, a length of the passageway and a distance from the passageway outlet to an outward imaginary plane is maintained to a constant value LB to form a plane wave B by composing wave surfaces of re-emitted sound waves having the second same phase after passing through each passageway 22-*i***.

The first phase of the first plane wave A formed by the sound waves passed through the upper passageway group (first passageway group) 21 is set to advance by a phase difference of 240° ±60° with the sound wave of a sound reducing target frequency to be reduced (such as 1250 Hz) with respect to the second phase of the second plane wave B formed by the sound waves passed through the lower passageway group (second passageway group) 22.

In the engine 14 for vehicles, the sound pressure level some times becomes the highest in a frequency zone of about 1250 Hz.

FIG. 2 illustrates a preferred embodiment for forming the first passageway group 21 and the second passageway group 22 by ten flat plates such as to advance the phase of the first plane wave A by a phase difference of 240° with respect to the phase of second plane wave B in order to exhibit a sound reducing effect by interference in case of the sound wave of a frequency of 1250 Hz to be reduced.

In FIG. 2, lengths of flat plates (S1, S2, . . . S10 from the above) for constructing each passageway **21-*i*, 22-*i*** measured in the longitudinal direction of the passageway are 64 mm, 64 mm, 56 mm, 20 mm, 140 mm, 140 mm, 116 mm, 87 mm, 56 mm, and 35 mm, and inclined angles $\theta$ of flat plates are all 30°, and spaces between adjacent flat plates are all 25 mm.

Figure 3:
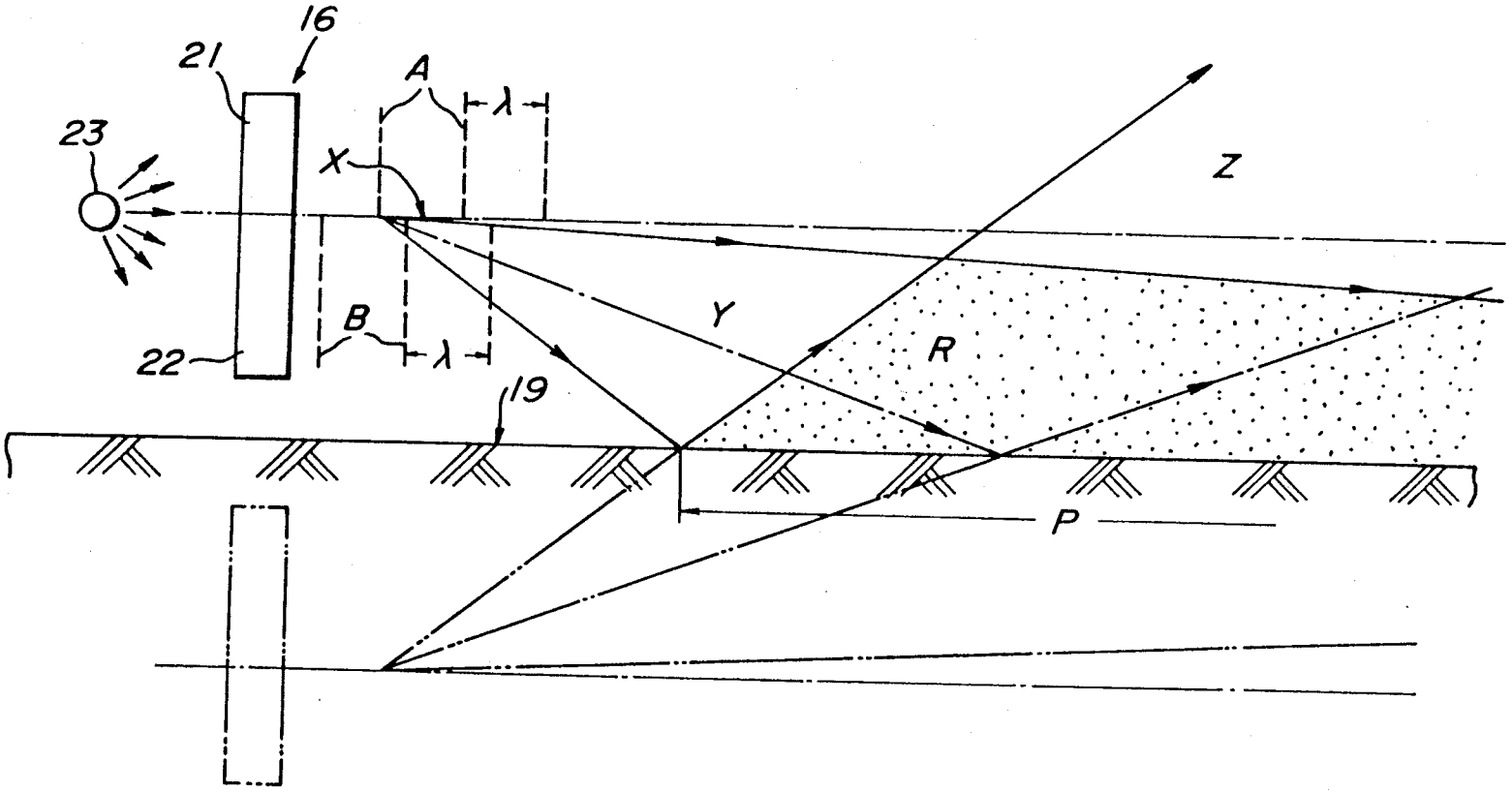
FIG. 3 is a schematic view showing interference of sound waves of the noise reducing apparatus according to the invention.

FIG. 3 schematically shows interference of the sound waves passed through the noise reducing apparatus 16 shown in FIG. 2.

Referring to FIG. 3, the phase of the first plane wave A formed by the sound waves passed through the first passageway group 21 from the sound source 23 advances by a phase difference of 240° with respect to the phase of the second plane wave B formed by the sound waves passed through the second passageway group 22, a sound reducing effect is obtained by interference at a boundary zone X of these first plane wave A and the second plane wave B. Further, the sound reducing zone is widened downwardly as shown by a region Y as the plane waves proceed.

The sound reducing region Y widened downwardly is reflected by the surface of the earth 19 to reverse its direction, and further proceeds towards an upper sound reducing region Z.

In this case, there is formed a composite space R where a sound wave before reflection and a sound wave after reflection cross each other above a range P where the sound reducing region Y impinges upon the surface of the earth 19.

Since various plane waves having different wavelengths and phases interfere with each other in this composite space R, it is possible to obtain a stable sound attenuation zone having a further lowered noise level. Therefore, particularly in case of setting any instruments which require low noise surroundings, it is preferable to arrange the instruments in this composite space R.

Figure 4:
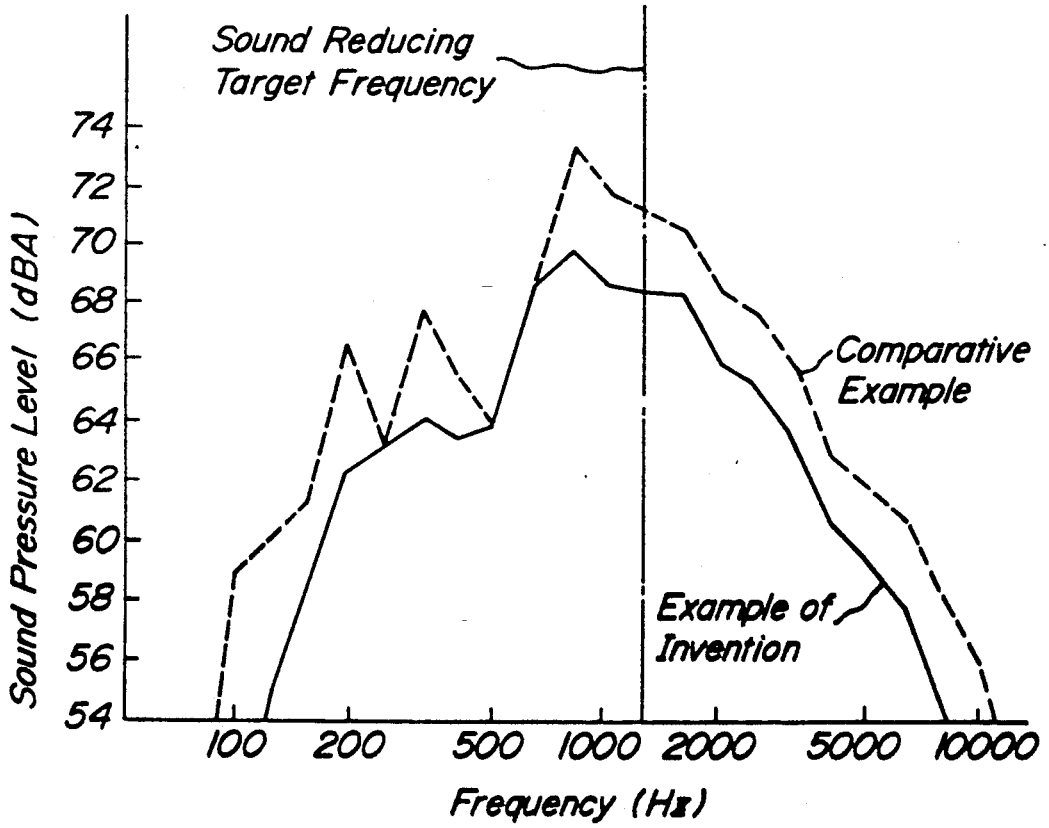
FIG. 4 is a graph of sound pressure spectrum showing a sound reducing effect of the noise reducing apparatus of FIG. 2 by comparing with the prior art.

Referring to a graph of FIG. 4, there are comparatively shown spectrums of sound pressure levels of noise from a vehicle provided with the noise reducing apparatus 16 (Example) according to the invention shown in FIGS. 1 and 2 and noise from the prior vehicle (Comparative Example).

The graph of FIG. 4 shows the sound pressure level of each frequency component at the time when the noise level becomes maximum in case of passing a microbus at a speed of 40 km per hour at the place 7.5 m spaced from the vehicle center.

The measurement result of FIG. 4 shows that a sound reducing effect of 4 dB can be attained at a sound reducing target frequency of 1250 Hz by applying the apparatus of the invention to the engine room 13 of a vehicle.

Thus, when the invention is applied to an engine room of a vehicle, it is possible to attain a sufficient sound reducing effect by only interference of sound waves as maintaining permeability without using any sound absorbing material.

Figure 5:
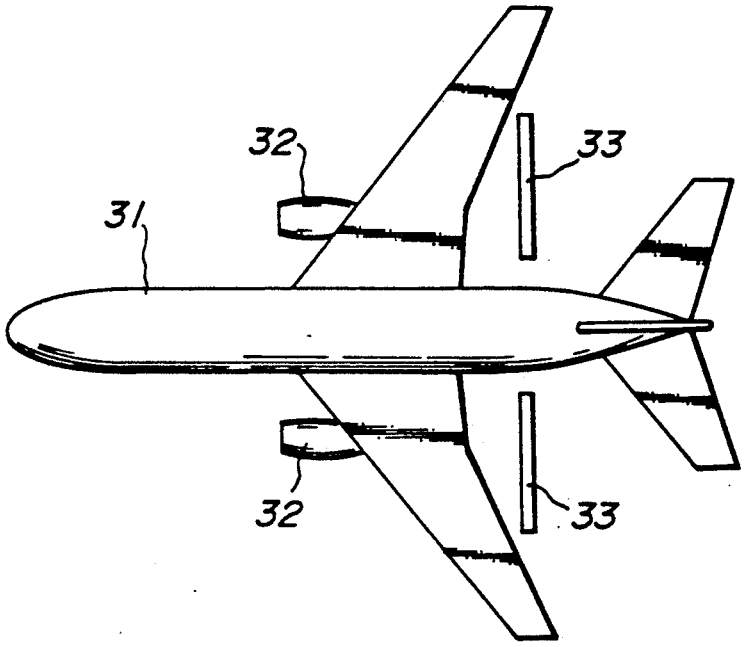
FIG. 5 is a schematic plan view illustrating the noise reducing apparatus according to another embodiment of the invention applied to the engine of an aeroplane.

FIG. 5 shows an embodiment of using the noise reducing apparatus according to the invention for reducing noises generated from the engine of an aeroplane.

Referring to FIG. 5, the sound wave interference-type sound reducing apparatuses 33, 33 according to the invention are arranged on the ground in the rear of both engines 32, 32 secured to both wings of an aeroplane 31, respectively.

A distance from the engine 32 to the noise reducing apparatus 33 is 10 m.

Figure 6:
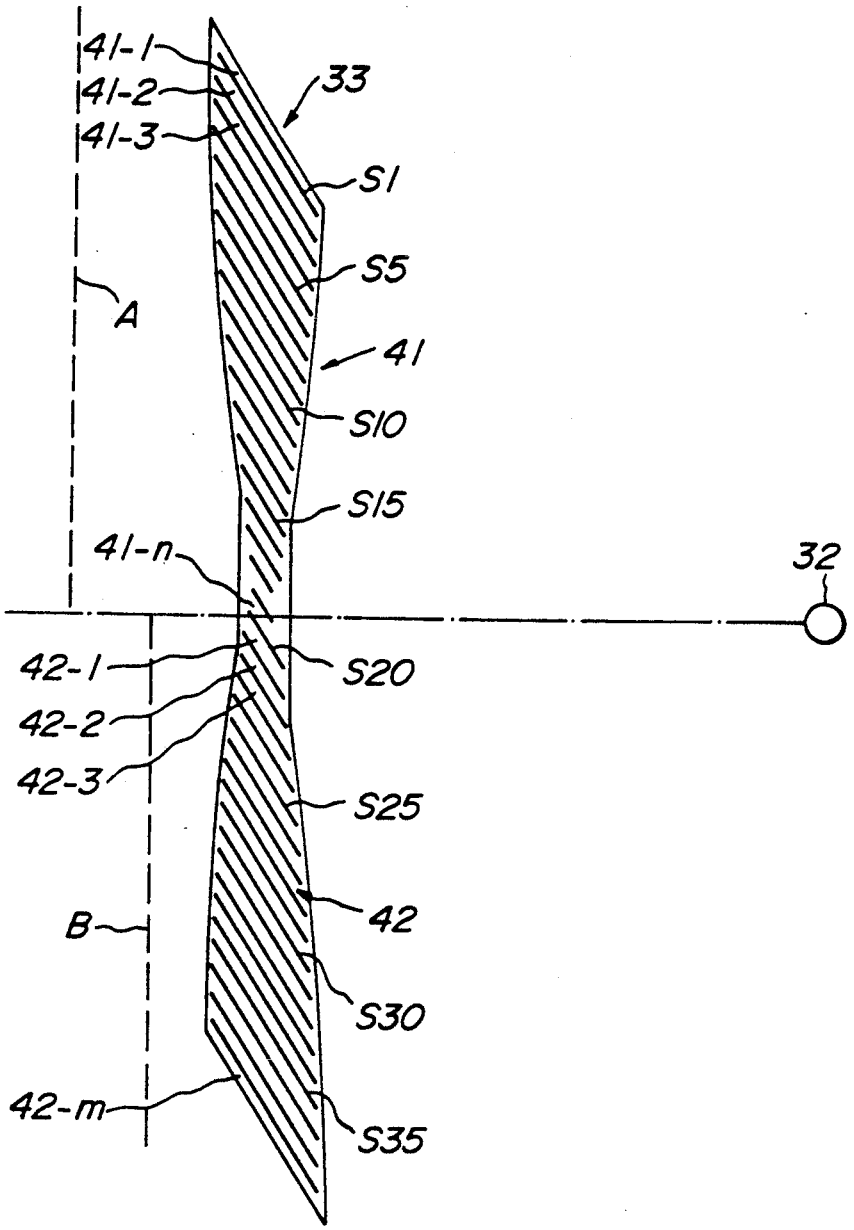
FIG. 6 is a longitudinal cross sectional view of the noise reducing apparatus shown in FIG. 5.

FIG. 6 illustrates a longitudinal cross section of the noise reducing apparatus 33 (either one of them) in FIG. 5.

This noise reducing apparatus 33 is about 6 m in height and about 10 m in width, and is composed of a hollow body comprising a first upper passageway group 41 and a second lower passageway group 42.

The first passageway group 41 comprises a plurality of first passageways 41-1, 41-2, . . . 41-*n* aligned in parallel with each other, and the length of these passageways is constructed such as to form a first plane wave A by sound waves having a first same phase passed through a sound source n.

The second passageway group 42 comprises a plurality of second passageways 41-1, 42-2, . . . 42-*m* aligned in parallel with each other, and the length of these passageways is constructed such as to form a second plane wave B by sound waves having a second same phase passed through each second passageway 42-1, 42-2, . . . 42-*m* from the sound source (engine) 32.

The principle and basic construction of the noise reducing apparatus 33 is substantially the same as those of FIG. 2, but as understood from the drawing, upper and lower passageway groups 41 and 42 of the noise reducing apparatus in FIG. 6 are composed of much more passageways than the case of FIG. 2.

This case is also set to advance the phase of the first plane wave A formed by sound waves passed through the upper passageway group 41 by a phase difference of 240° ±60° with respect to the phase of the second plane wave B formed by sound waves passed through the lower passageway group 42 with the sound wave of a sound reducing target frequency (such as 2000 Hz).

It is preferable to set the sound reducing target frequency (such as 2000 Hz) at a frequency which noise level from the sound source (engine) 32 is the highest.

In the noise reducing apparatus 33 of FIG. 6, each passageway 41-1, 41-2, . . . 41-*n*, 42-1, 42-2, . . . 42-*m* of the first passageway group 41 and the second passageway group 42 is composed of forty flat plates S1, S2, . . . S40 in total.

An inclined angle $\theta$ of each flat plate Si is 30°, and a distance between adjacent flat plates is 75 mm.

Table 1 shows the lengths of said forty flat plates (S1, S2, . . . S40 from the above) measured in the longitudinal direction of the passageway.

TABLE 1 unit: mm

| | |
|---|---|
| S1 | 1254 |
| S2 | 1251 |
| S3 | 1239 |
| S4 | 1221 |
| S5 | 1197 |
| S6 | 1167 |
| S7 | 1131 |
| S8 | 1098 |
| S9 | 1044 |
| S10 | 990 |
| S11 | 936 |
| S12 | 876 |
| S13 | 813 |
| S14 | 744 |
| S15 | 672 |
| S16 | 594 |
| S17 | 516 |
| S18 | 432 |
| S19 | 345 |
| S20 | 255 |
| S21 | 420 |
| S22 | 504 |
| S23 | 582 |
| S24 | 657 |

TABLE 1-continued

| | |
|---|---|
| S25 | 726 |
| S26 | 792 |
| S27 | 855 |
| S28 | 912 |
| S29 | 966 |
| S30 | 1014 |
| S31 | 1062 |
| S32 | 1107 |
| S33 | 1146 |
| S34 | 1182 |
| S35 | 1215 |
| S36 | 1245 |
| S37 | 1272 |
| S38 | 1296 |
| S39 | 1320 |
| S40 | 1338 |

The embodiment of the invention explained by referring to FIGS. 5 and 6 is also possible to exhibit the same interference effect of mutual plane waves as explained in FIGS. 2 and 3 and further possible to form a sound attenuation zone for stably reducing the sound pressure level by a large margin by forming a composite space R where an incident wave crosses a reflected wave.

Figure 7:
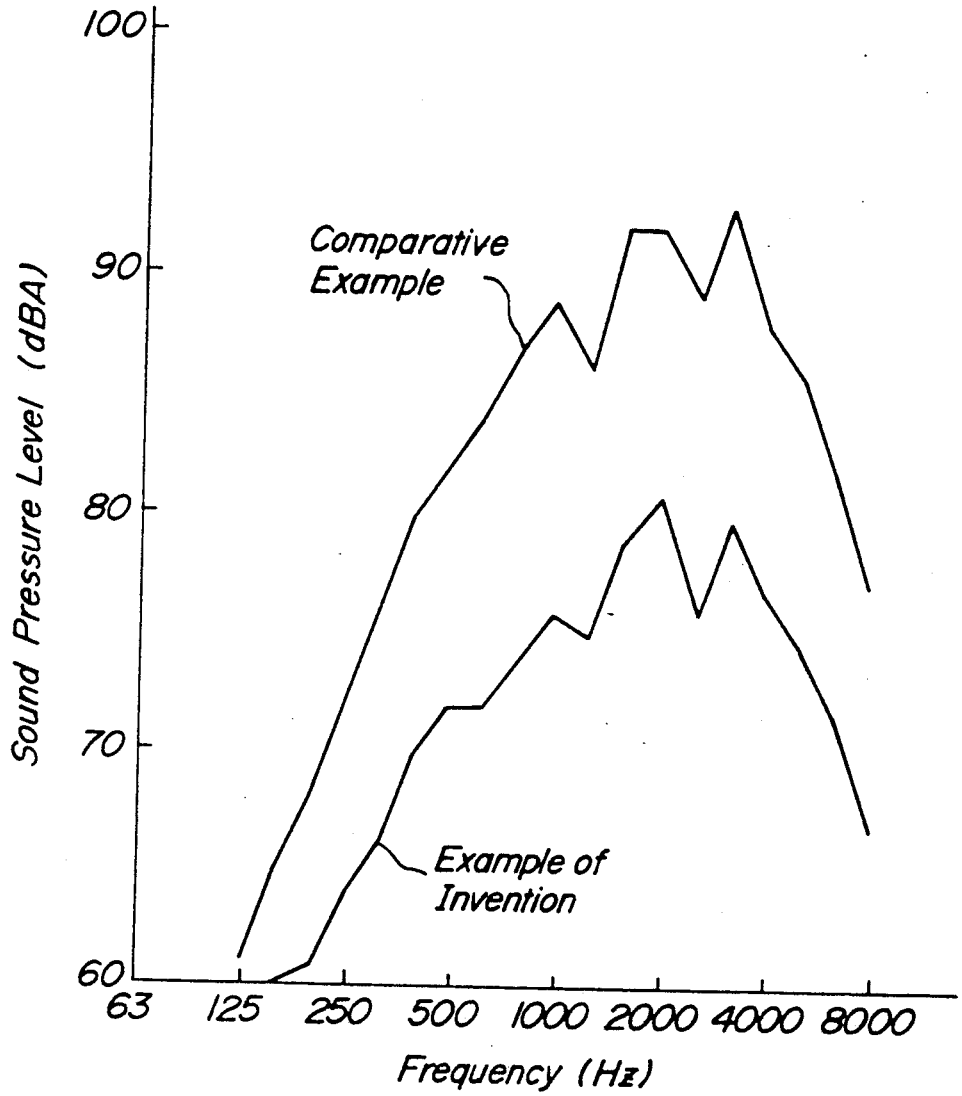
FIG. 7 is a graph of sound pressure spectrum showing a sound reducing effect of the noise reducing apparatus shown in FIG. 6.
Figure 8:
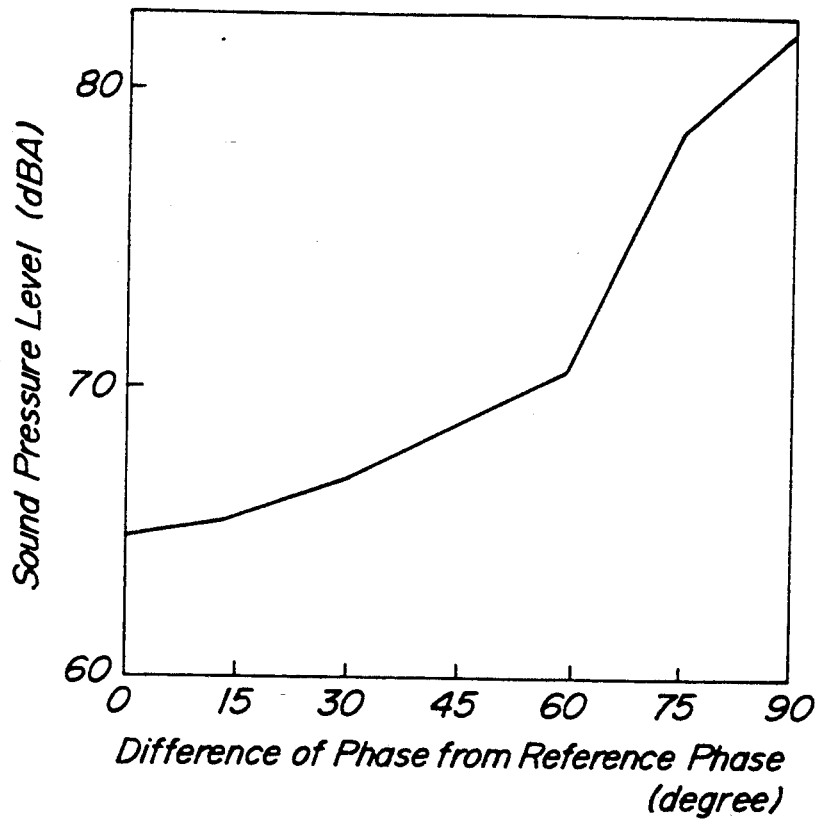
FIG. 8 is a graph showing the relation between a phase difference of sound waves in the passageway group and a sound reducing effect.
Figure 9:
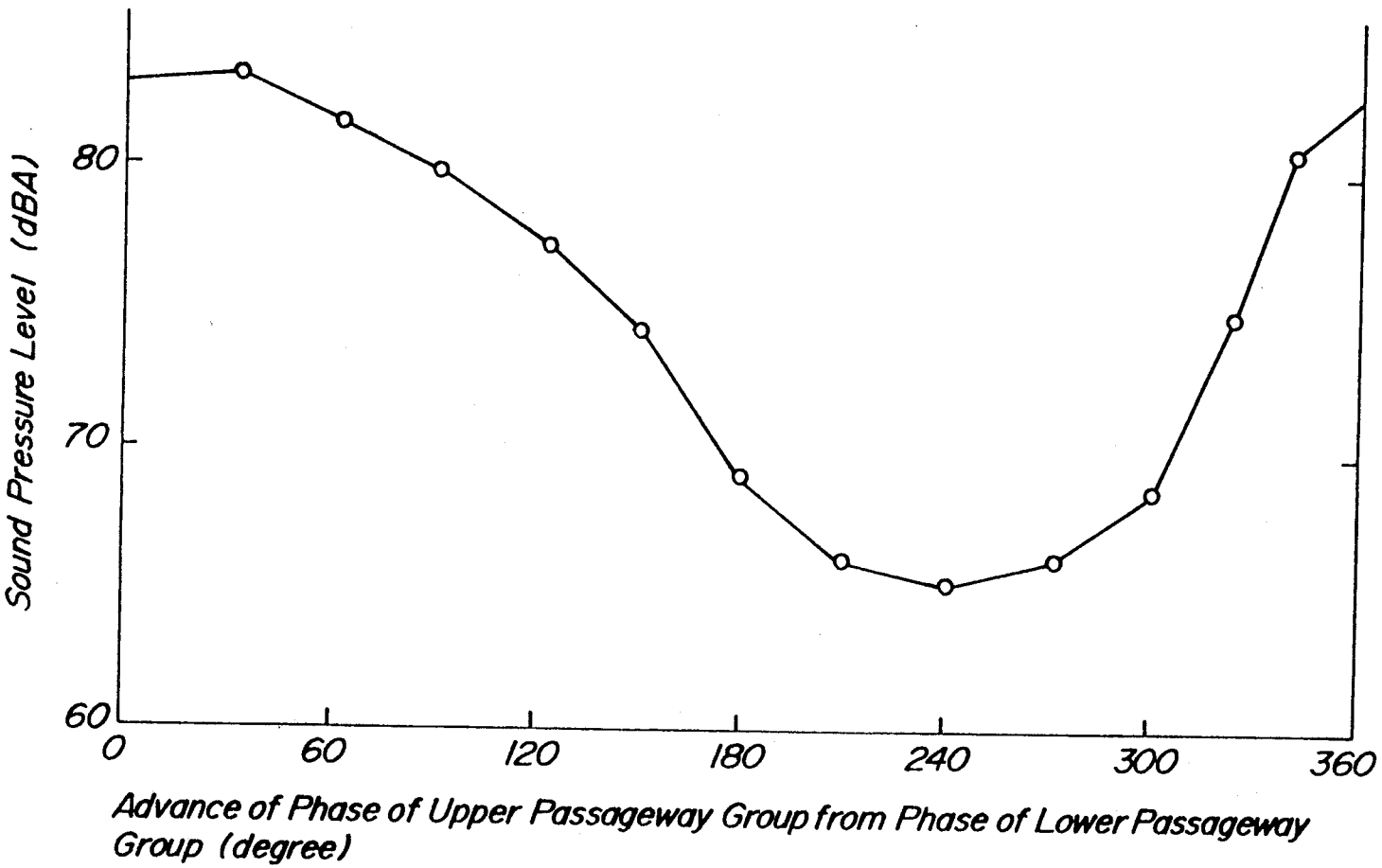
FIG. 9 is a graph showing the relation between a phase difference of sound waves in the passageway groups and a sound reducing effect.

FIG. 7 is a graph showing the spectrums of the sound pressure levels in case of using the noise reducing apparatus 33 (Example) and in case of using no noise reducing apparatus 33 (Comparative Example) explained in FIGS. 5 and 6.

The spectrums of the sound pressure levels shown in FIG. 7 are values measured at 150 m behind the engine 32 (FIG. 5).

As apparent from the spectrums of FIG. 7, the sound reducing effect of 12 dB could be attained at a sound reducing target frequency 2000 Hz, and engine noises in the rear of the aeroplane 31 could be extremely reduced.

Thus, according to the embodiment of FIGS. 5 and 6, the noises can be reduced by the interference effect of sound waves passed through the passageway groups 41, 42, and as a result, a tremendous noise reducing effect can be obtained without disturbing an air flow from the engine 32 of the aeroplane 31 under a normal suction and exhaust condition of the engine.

What is claimed is:

1. A noise reducing apparatus for reducing noise reflected on a ground surface, comprising; means for defining first and second groups of passageways, the first passageway group comprising a plurality of first passageways aligned in parallel with each other for forming a first flat wave A by sound waves having a first same phase passing through each first passageway from a sound source and, the second passageway group comprising a plurality of second passageways aligned in parallel with each other for forming a second flat wave B by sound waves having a second same phase passing through each second passageway from said sound source, said first passageway group being positioned above said second passageway group with all of said first and second passageways being in parallel to each other, and the first phase of said first flat wave being advanced by a phase difference of 240° ±60° with respect to the second phase of said second flat wave.

2. The noise reducing apparatus of claim 1 further comprising means to mount said apparatus to a vehicle having an engine to reduce engine noise.

3. The noise reducing device of claim 1 wherein the number of said first passageways is equal to the number of said second passageways.

4. The apparatus claimed in claim 1, wherein a length of each passageway of the first passageway groups is determined such that the sum of a distance from a sound source to its passageway inlet, a length of the passageway and a distance from the passageway outlet to an outward imaginary plane is a constant length LA and, a length of each passageway of the second passageway group is determined such that the sum of a distance from a sound source to its passageway inlet, a length of the passageway and a distance from its passageway outlet to an outward imaginary plane is a constant length LB such as to advance the first phase of the first plane wave A by a phase difference of 240° ±60° with respect to the second plane wave B.

5. The apparatus claimed in claim 1, wherein the means for defining the first and second groups of passageways comprises a plurality of spaced plates.

6. The noise reducing device of claim 5 wherein a spacing between flat plates forming each of said first and second group of passageways is constant within a group.

7. The noise reducing device of claim 5 wherein all of said flat plates are parallel to each other and inclined with respect to said noise source.

8. The noise reducing device of claim 6 wherein the lengths of said flat plates are different.

* * * * *